United States Patent [19]

Nanba et al.

[11] Patent Number: 4,625,431

[45] Date of Patent: Dec. 2, 1986

[54] STRIP COOLING APPARATUS FOR CONTINUOUS ANNEALING FURNACE

[75] Inventors: Tadashige Nanba; Yasuo Tokita; Tetsuo Fukuzawa; Mitsushige Shiota; Toshinori Yoshida; Masato Yokata; Kozaburo Ichida; Norichika Nagira; Goki Yamamoto; Masashi Mitsuzuka, all of Kitakyushu, Japan

[73] Assignee: Nippon Steel Corporation, Tokyo, Japan

[21] Appl. No.: 788,430

[22] Filed: Oct. 17, 1985

[30] Foreign Application Priority Data

Nov. 14, 1984 [JP] Japan ..... 59-238506
Nov. 14, 1984 [JP] Japan ..... 59-238507
Nov. 14, 1984 [JP] Japan ..... 59-171681[U]

[51] Int. Cl.[4] ..... F26B 19/00

[52] U.S. Cl. ..... 34/62; 34/67; 266/111

[58] Field of Search ..... 34/20, 62, 65, 66, 67; 148/156; 266/111

[56] References Cited

U.S. PATENT DOCUMENTS 3,058,840 10/1962 Kerr et al. ..... 266/111
3,068,586 12/1962 Vaughan et al. ..... 34/20
4,363,471 12/1982 Yanagishima et al. ..... 266/111
4,375,283 3/1983 Shimoyama et al. ..... 266/111
4,379,547 4/1983 Shimbashi et al. ..... 266/111
4,423,856 1/1984 Takahashi et al. ..... 266/111
4,428,128 1/1984 Coulson et al. ..... 34/160
4,571,274 2/1986 Yanagishima et al. ..... 148/156

*Primary Examiner*—Albert J. Makay
*Assistant Examiner*—David W. Westphal
*Attorney, Agent, or Firm*—Wenderoth, Lind & Ponack

[57] ABSTRACT

A strip cooling apparatus for a continuous annealing furnace for continuously treating longitudinally fed steel strip has a pair of cooling gas chambers attached to the furnace walls on both sides of the strip so that the front of each chamber faces the strip. Each cooling gas chamber has nozzles having round outlets opening toward the strip surface on its front side to shoot forth a cooling gas jet against the strip furnace. The nozzle is separated from the strip by a distance z not larger than 70 mm and projected from the front of the cooling gas chamber by a length of not less than (100—z) z) mm. The cooling apparatus also has a pair of rotatably holding rolls reciprocatably attached to the furnace walls to press the strip at a right angle thereto. The holding rolls holds the strip and prevents the occurrence of fluttering.

3 Claims, 13 Drawing Figures

STRIP COOLING APPARATUS FOR CONTINUOUS ANNEALING FURNACE

BACKGROUND OF THE INVENTION

1. Field of the Invention

This invention relates to an apparatus for cooling strip in a continuous annealing furnace, and more particularly to an apparatus that cools strip at high cooling rate.

2. Description of the Prior Art

Continuous annealing furnaces, as is well known, are designed to provide heating, short-time soaking, cooling and, when necessary, overaging to steel strip.

For the achievement of the desired strip properties, not only heating (annealing) temperature and soaking time but also the manner of cooling plays an important role. It is believed, for instance, that fast cooling followed by overaging provides good aging and anti-fluting characteristics. The cooling of strip after heating and soaking is accomplished by use of various kinds of cooling mediums. Different cooling rates are employed with different cooling mediums.

With water cooling, considerably high cooling rates, including even those which permit what are known as superhigh-rate cooling, are obtainable. The problem with water cooling is that the shape of strip is apt to get damaged by hardening-induced strains. Contact with water forms oxide films on the surface of strip, the removal of which calls for the provision of an additional device which results in an economical disadvantage.

Cooling by contact with rolls cooled by passing water or other cooling mediums therethrough is a method used for the solution of the problems just described. The problem with this method is as follows: The strip passing through a continuous annealing furnace does not always possess adequate flatness. As such, some portion of the strip may get out of contact with the cooling roll (resulting in uneven cooling), thereby bringing about the deformation of the strip. To avoid this, some strip flattening means should be provided ahead of the point where the cooling roll comes in contact with the strip, at the expense of increased cost.

Another widely used cooling method uses gas jet. Although the cooling rate of this method is lower than that of the water and roll-contact cooling, relatively uniform cooling can be achieved. An example of this type of cooling apparatus was disclosed by the U.S. Pat. No. 3,068,586.

Gas cooling means contained in a vertical continuous annealing furnace comprises several cooling gas chambers provided between rotatable feed rolls at the top and bottom of the furnace over which the strip is passed. Cooling is done by directly shooting forth a stream of cooling gas against the strip from nozzles provided to the cooling gas chamber. To achieve an improvement in the anti-fluting characteristics of the strip, the cooling rate must be increased further. This goal will be achieved by shooting forth a greater amount of gas against the strip. However, the goal will be unattainable if the strip and the nozzle tip are wide apart since the speed of the gas jet is much lower when it reaches the strip than the moment of shooting forth. To achieve the desired goal of cooling under such an unfavorable condition, a very large quantity of gas must be supplied, which is by no means advantageous from the standpoint of capital investment, equipment installation space and running cost. To ensure efficient cooling, the distance between the nozzle tip and the strip should be kept relatively small.

Between the feed rolls at the top and bottom (which are approximately 20 m apart although the distance varies from furnaces to furnaces), the strip travels at a speed of 200 to 1000 m/min. As such, the strip may suffer from the resonance caused by the dislocation eccentricity) of the rolls and the vibration known as fluttering resulting from the shooting force of cooling gas against the strip. When the distance between the nozzle tip and the strip is reduced or the amount of gas supply is increased, the gas is shot forth against the strip surface at a greater speed to cause greater fluttering. When excessive fluttering occurs, the strip may come in contact with a gas ejecting device to damage the device and/or the strip itself. Uneven breadthwise cooling, which might result from such overmuch fluttering, is likely to cause deformation which sometimes and up a serious warp known as cooling buckling.

SUMMARY OF THE INVENTION

An object of this invention is to provide a cooling apparatus for continuous annealing furnaces that cools strip at high speed using a gas jet as the cooling medium.

Another object of this invention is to provide a cooling apparatus for continuous annealing furnaces that permits efficient uniform breadthwise cooling of strip while completely preventing the occurrence of buckling.

A cooling apparatus according to this invention has one or more cooling gas chambers, each of which having nozzles with a round outlet at the tip of each opening toward the strip surface on the front side thereof. The distance z between the strip and nozzle tip is not larger than 70 mm. The nozzle projects from the front surface of the cooling gas chamber by a length of not less than (100−z) mm. The cooling apparatus of this invention also possesses paired rotatable holding rolls that are disposed aslant to each other on both sides of the strip. The rolls are attached to the furnace wall in such a manner as to be moved back and forth, thereby pushing the strip in the direction perpendicular to the surface thereof.

The cooling apparatus of this invention permits bringing the gas nozzles to the closest possible point from the strip without causing fluttering and strip damage by sdjusting the extent to which the holding rolls are pressed beyond the threading line of the strip. The cooling gas shooting distance and the length of nozzle projection are specified so that high-efficiency and uniform breadthwise cooling is achieved. No cooling buckle occurs on the strip that is cooled uniformly across the width thereof.

This invention also defines the ratio of the total area of the nozzle outlets to the area of the front surface of the cooling gas chamber as well as the nozzle outlet diameter with which the most efficient shooting is achieved. The ratio and diameter established by this invention are 2 to 4 percent and not larger than one-fifth of the gas shooting distance.

With these provisions, the cooling apparatus of this invention possesses higher cooling capacity than the conventional cooling apparatuses while using a relatively small-capacity blower.

As a consequence, metallurgically preferable cooling rate can be obtained easily without using heavyduty blowers and ducts. Not only installation space and capital investment but also blower power requirement can be cut down drastically. This invention also offers several benefits from the viewpoint of product properties. The cooling apparatus of this invention can achieve such high cooling rates, with relative ease, as have been conventionally unattainable because of equipment cost limitations.

For instance, a cooling rate not lower than 100° C./sec. that is desirable for light-tempered tinplate steel is possible. This leads to the acceleration of overaging and easy production of tinplate steel with light tempering. Also, a cooling rate of not lower than 50° C./sec. is applicable to cold rolled strip of 1 mm and under in thickness to impart particularly high drawability. Addition of alloying elements to high-tensile steel can be saved, too.

The cooling apparatus according to this invention is equipped with means to control the peripheral speed of said holding rolls so that the peripheral speed of the rolls is maintained at the same level of the travel of the travel speed of the strip. Therefore, no slip occurs between the travelling strip and the holding rolls, as a result of which the strip produced has smooth surfaces free of slip marks.

DESCRIPTION OF THE PREFERRED EMBODIMENTS

Now preferred embodiments of this invention will be described in detail by reference to the accompanying drawings.

Figure 1:
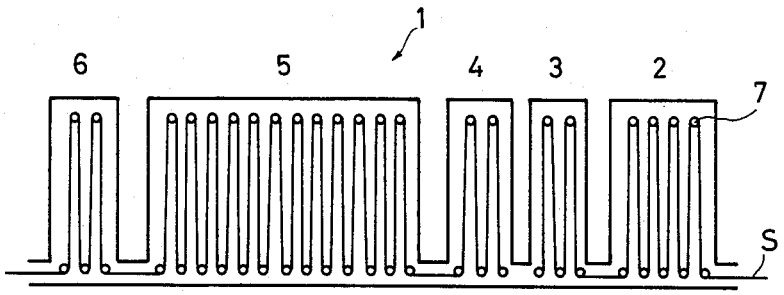
FIG. 1 a schematic illustration of a continuous annealing furnace containing a cooling apparatus according to this invention.

A continuous annealing furnace 1 of the vertical type shown in FIG. 1 comprises a heating zone 2, a soaking zone 3, a primary cooling zone 4, an overaging zone 5 and a secondary cooling zone 6. A large number of feed rolls 7 are provided at the top and bottom of the continuous annealing furnace 1. The feed rolls are driven by driving means (not shown) comprising a motor, reduction gear, etc. Passed over the feed rolls 7, strip S travels up and down within the furnace 1. An ordinary set of entry and delivery end equipment, such as a payoff roll, pinch rolls, an entry-side and delivery-side looper, tension reels and the like (not shown), are provided ahead of and following the continuous annealing furnace 1.

Figure 2:
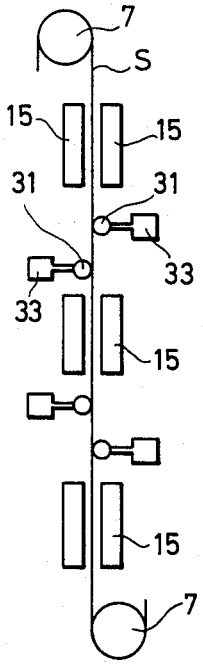
FIG. 2 is an enlarged view of a cooling apparatus which is a preferred embodiment of this invention.

In the preferred embodiment being described, a cooling apparatus according to this invention is contained in the primary cooling zone 4 which is shown in FIG. 2 on an enlarged scale.

The primary cooling zone 4 has three gas jet shooting devices 15 disposed along the travel line of the strip S. The gas jet shooting device 15 shoots forth a stream of cooling gas to cool the strip S.

Figure 3:
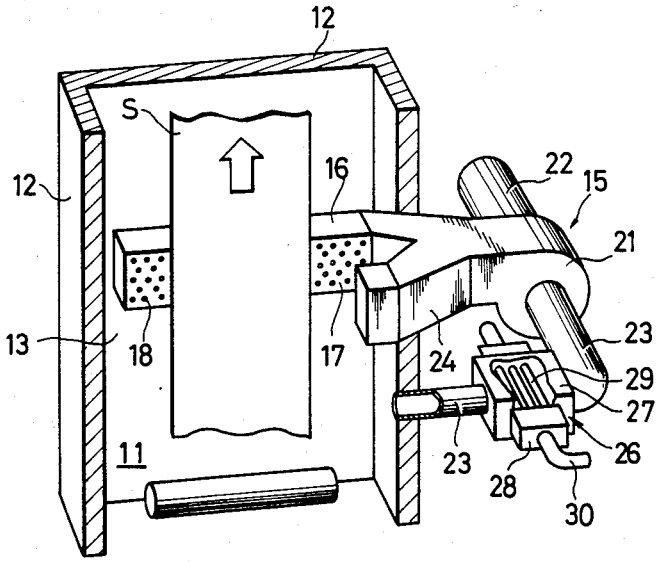
FIG. 3 is a perspective view of a gas jet shooting device.

FIG. 3 shows the structure of the gas jet shooting device 15.

The gas jet shooting device 15 consists essentially of a cooling gas chamber 16, a circulating fan 21 and a heat-exchanger for cooling 26. Two cooling gas chambers 16 are provided on both sides of the strip S. Each cooling gas chamber 16 is box-shaped, with the front surface 17 thereof facing the strip S. The cooling gas chambers 16 are contained in the furnace chamber 11 and fastened to the furnace wall 12. A large number of nozzles 18 are provided on the front surface 17 of the cooling gas chamber 16 that faces the strip S. The circulation fan 21 is positioned outside the furnace chamber 11 and driven by a motor 22. While the end of the intake duct 23 of the circulation fan 21 opens into the furnace chamber 11, the discharge duct 24 thereof is connected to the cooling gas chamber 16. The heat-exchanger for cooling 26 is provided midway on the intake duct 23. The heat exchanger 26 has many fin tubes 29 extending across the chamber 27 thereof. Both ends of the fin tubes 29 are fastened to headers 28 attached to the side walls of the chamber 27. To each header is supplied cooling water from a cooling water pipe 30. The furnace atmosphere gas taken into the intake duct 23 is cooled in the heat-exchanger 26 by contact with the fin tubes 29 and pressurized by the circulation fan 22. The pressurized cooling gas is shot forth as a jet stream "a" through the nozzles 18 of the cooling gas chamber on to the surface of the strip S to achieve the desired cooling.

Figure 4A:
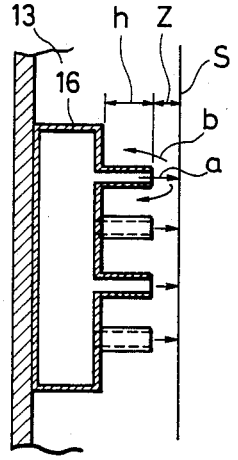
FIGS. 4(*a*) and 4(*b*) show a cross section and a front view of a cooling gas chamber equipped with projected nozzles.
Figure 4B:
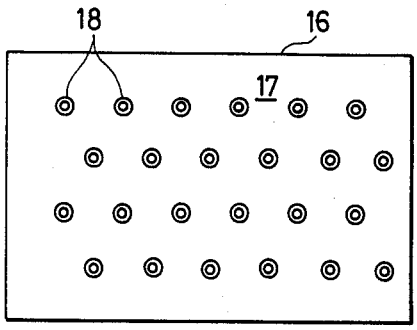
Figure 5:
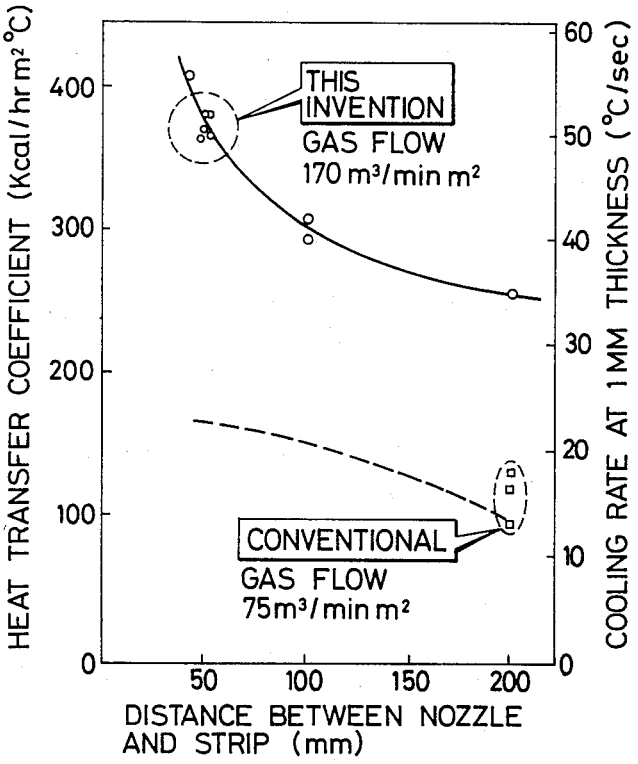
FIG. 5 graphically shows the relationship between the gas shooting distance and the cooling ability.

FIG. 4 shows the nozzles 18 provided on the front surface 17 of the cooling gas chamber 16. The projected nozzles 18, each of which has a round outlet, are arranged in a zigzag order on the front surface 17 of the cooling gas chamber 16. The shooting distance z, or the distance between the strip S and the tip of the nozzle 18, is not larger than 70 mm. FIG. 5 shows the relationship between the shooting distance z and cooling ability (cooling rate with 1 mm thick strip). Metallurgically, it is known that addition of alloying elements to high-tensile steel can be cut down if cooling rates of 50° C./sec. or above are obtained for cold rolled strip (approximately 1 mm in thickness). For tinplate steel (approximately 0.5 mm thick), fluting tendencies can be decreased by cooling at a rate of approximately 100° C./sec. (or 50° C./sec. for 1 mm thick strip). As is obvious from FIG. 5, the above cooling rate can be obtained by limiting the shooting distance z to approximately 50 mm or under. Furthermore it is easily anticipated that the same cooling rate can be obtained by limiting the shooting distance z to 70 mm or under if the gas flow rate is slightly increased. The shooting distance z with the conventional apparatuses has been at least 100 mm. To keep strip out of contact with the cooling gas chamber, the shooting distance z of 150 to 20 mm has been common with the conventional vertical-type furnaces. By contrast, the shooting distance z of the apparatus according to this invention is much smaller than conventional. The minimum value of the shooting distance z is commonly approximately 20 mm though the value varies when the profile of strip changes due to edge waviness etc.

Figure 6:
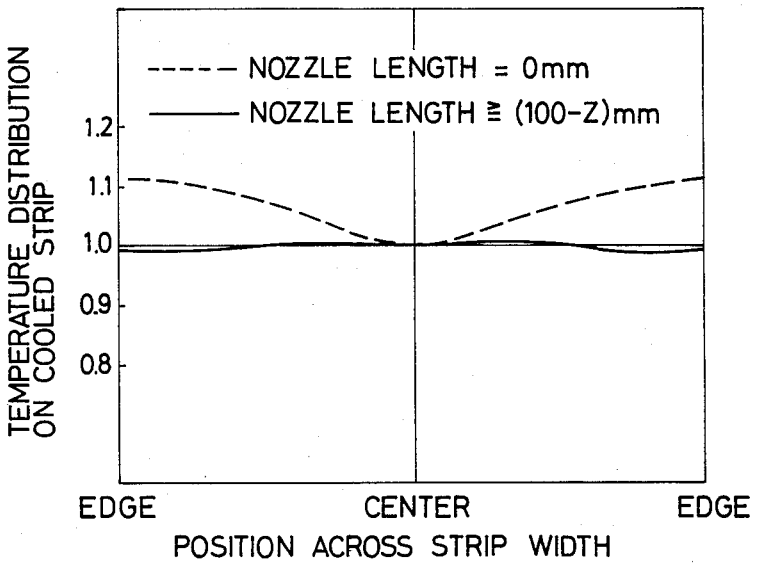
FIG. 6 graphically shows the relationship between the length of the projected nozzle and the temperature distribution across the width of the cooled strip.
Figure 7:
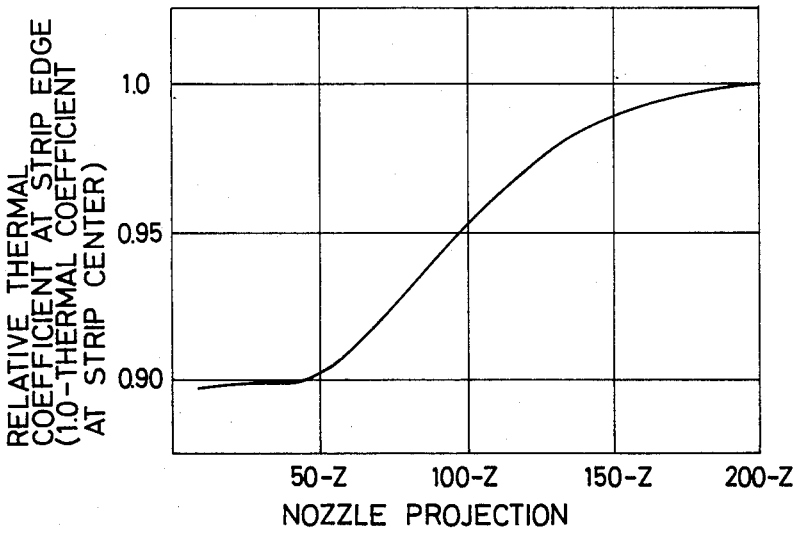
FIG. 7 graphically shows the relationship between the length of the projected nozzle and the relative coefficient of heat transfer.

The volume of gas to be ejected from the gas jet shooting device must be increased to achieve high cooling rates. Meanwhile, the effect of the side flow of the jet stream should be eliminated as much as possible to improve the temperature distribution across the width of strip. For these reasons, the required clearance between the strip S and the nozzle 18 is secured by projecting the nozzle 18 by the distance h which is not less than (100−shooting distance z) mm as shown in FIG. 4. FIG. 6 shows the relationship between the nozzle length and the temperature distribution across the width of cooled strip. FIG. 7 shows the relationship between the nozzle length and the relative coefficient of heat transfer (i.e., the coefficient of heat transfer at the edge of strip based on the assumption that the coefficient of heat transfer in the middle of strip is 1.0). With the nozzle length of (100−shooting distance Z) mm and above, as is obvious from the above diagrams, the side flow rate of the jet stream is lowered and uniform cooling across the strip width is accomplished. By projected the nozzle 18, the gas jet shot forth against the strip face is allowed to flow, as the stream "b" shown in FIG. 4, from the clearance z between the strip S and the tips of the nozzles 18 into the free space 13 left within the furnace, thus assuring efficient cooling without interferring with the flow of a fresh stream of gas jet.

Figure 8:
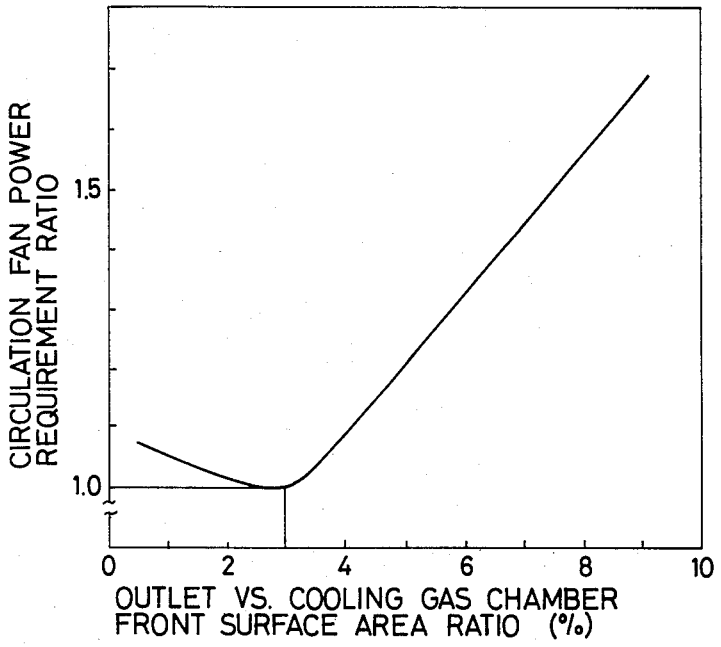
FIG. 8 graphically shows the relationship between the ratio of the area of the nozzle holes to the strip area and the power requirement of the circulation fan.

The ratio of the total area of the outlets of all nozzles 18 to the area of the front surface 17 of the cooling gas chamber 16 should preferably be from 2 to 4 percent. FIG. 8 shows the relationship between this ratio and the power requirement of the circulation fan. The curve in FIG. 8 shows that the most efficient cooling is achieved when the ratio falls within the 2 to 4 percent range. When the ratio is greater, the speed of the gas flow, as shot forth from the nozzle, per unit gas volume drops, with the result that the speed with which the gas jet reaches the strip becomes still lower under the influence of the side-flowing gas. When the ratio is too small, the gas flow rate per unit gas volume increases to bring about an increase in the pressure loss at the nozzle and the power requirement.

Figure 9:
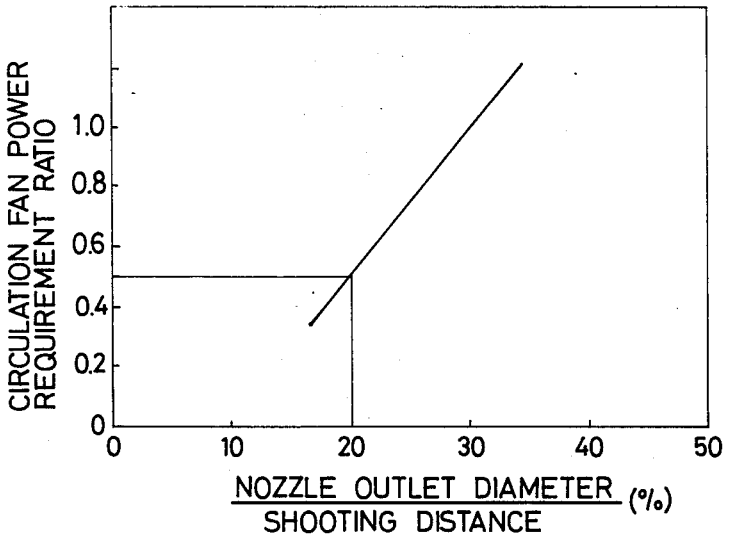
FIG. 9 graphically shows the relationship between the ratio of the nozzle diameter to the gas shooting distance and the power requirement of the circulation fan.

The nozzle diameter should preferably be smaller than one-fifth of the shooting distance z between the strip S and the tip of the nozzle. FIG. 9 shows the relationship between the ratio of the nozzle outlet diameter to the gas shooting distance and the power requirement of the circulation fan. For the achievement of high-efficiency cooling with the gas jet shooting device 15, it is advantageous to provide the nozzle 18 in a closely packed manner so that the streams of cooling gas are densely and uniformly distributed with the most effective portion thereof positioned at the point where cooling is effected. The smaller the nozzle outlet diameter, the smaller the power required for the operation of the circulation fan. However, when the nozzle outlet diameter is reduced without changing the ratio of the nozzle hole to the cooling area, the number of nozzles increases, entailing and increase in capital investment. In view of the above two factors, therefore, the practically economical nozzle outlet diameter is approximately one-fifth of the shooting distance z.

Table 1 compares the cooling capacities achieved by the technology of this invention and the conventional one.

TABLE 1

| Description | Conventional | This Invention |
|---|---|---|
| Cooling Capacity | Up to 100 kcal/hrm$^2$ °C. | Up to 400 kcal/hrm$^2$ °C. |
| Shooting Distance(z) | 100–200 mm | 20–70 mm |
| Nozzle Hole to Cooling Area Ratio | 2–10% | 2–4% |
| Nozzle Outlet Diameter | ≧⅛ z | ≦1/5 z |
| Cooling Air Supply Rate | Approx. 80 m$^3$/min. m$^2$ | Approx. 170 m$^3$/min. m$^2$ |
| Nozzle Length | 0 | ≧(100 - Z) mm |

An example of the specifications of an apparatus according to this invention is shown below.

Strip size: 0.3 to 1.6 mm thick by 600 to 1600 mm wide

Strip temperature: 650° to 400° C.

Strip travel speed: 200 m/min. (0.6 mm thick×1600 mm wide)

Cooling air supply: 3500 m$^3$/min. (at 100° C.)

Pressure of circulation fan: 700 mmAq

Nozzle outlet diameter: 9.2 mm

Distance between nozzle tip and strip: 50 mm

Nozzle length: 100 mm

Nozzle hole to cooling area ratio: 2.7 percent

In rapid cooling, it is an important requisite to prevent the fluttering of the strip S that occurs as the gas jet is shot forth and the strip S travels forward. It is also important to make sure that the strip S continues to travel without breaking even when buckling by cooling occurs.

Figure 10:
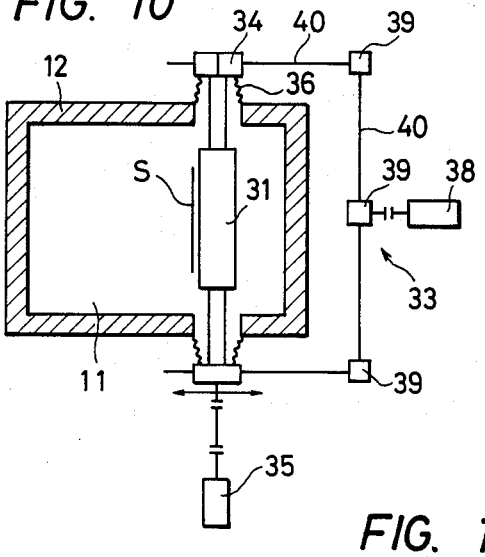
FIG. 10 is a plan view showing the structure of a holding roll driving means.

For this reason, the cooling apparatus of this invention has driven holding rolls 31 disposed between the gas jet shooting devices 15. The holding rolls 31 are adapted to be pushed in and out of the pass line and positioned in such a manner as not to face each other thereacross or spaced apart from each other vertically along the pass line. Driving means 33 is connected to each holding roll 31. FIG. 10 shows the details of the holding roll driving means 33. Each end of the holding roll 31 is rotatably supported by a bearing box 34 outside the furnace chamber 11. One end of the holding roll 31 is connected to a roll driving motor 35. The bearing box 34 can be moved perpendicular to the surface of the strip S. The space between the bearing box 34 and the furnace wall 12 is gastightly sealed by bellows 36. A holding roll reciprocating motor 38 is provided outside the furnace chamber 11. A holding roll reciprocating motor 38 is connected to the bearing box 34 through a distributor 39 and a transmission shaft 40. As the transmission shaft 40 rotates, the bearing box 34 is moved back and forth by the action of a screw mechanism (not shown). The driving means 33 sends forth the holding roll 31 so that the strip S is pressed beyond the pass line thereof. The amount by which the holding roll 31 is pressed forward or beyond the pass line ranges from 0 to approximately 100 mm depending upon the diameter of the holding roll 31, the thickness range of the strip treated by the continuous annealing apparatus in question and other factors. The minimum required amount is usually 5 mm. The holding rolls are spaced apart from each other by approximately 300 to 800 mm along the pass line.

Figure 11:
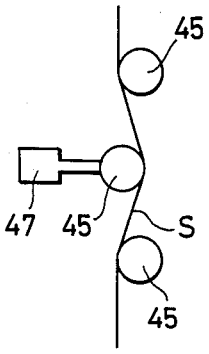
FIG. 11 shows another preferred embodiment of the holding roll.

FIG. 2 shows two holding rolls 31 spaced apart from each other. FIG. 11 shows another preferred embodiment in which three holding rolls 45 are provided, in which case it is preferrable to connect an in-and-out driving means 47 to the holding roll 45 in the middle. With this embodiment, it is unnecessary to adjust the pass line according to the amount by which the holding roll 45 is pressed forward.

With two or more holding rolls 31 or 45 disposed in a staggered and vertically spaced manner, the strip S is pressed at one point by one of the holding rolls 31 or 45 on one side thereof, then on the other side by the next staggered holding roll. Thus pressed beyond the pass line by the adjustable holding roll, strip of any thickness can be prevented from fluttering, even under the influence of resonance. Strip continues to travel forward without breaking even when heat buckle occurs because the strip is not held or restricted before it comes in contact with the holding roll 31 or 45.

When slip occurs between the holding roll and strip S, it is preferable to control the speed (peripheral speed) of the holding roll. Metal spray or other treatment may be applied on the surface of the holding roll for the prevention of buildup.

To control the peripheral speed of a holding roll, the peripheral speed of a feed roll provided in the vicinity thereof if determined first. Then the speed of the strip passing over the holding roll is determined on the basis of the determined speed of the feed roll and the distance between the feed roll and the holding roll, according to which, finally, the peripheral speed of the holding roll is controlled. Since the peripheral speed of the holding roll is controlled on the basis of the exact travel speed of the strip thereat, the strip travels smoothly over the holding roll without causing damage on the strip surface.

Figure 12:
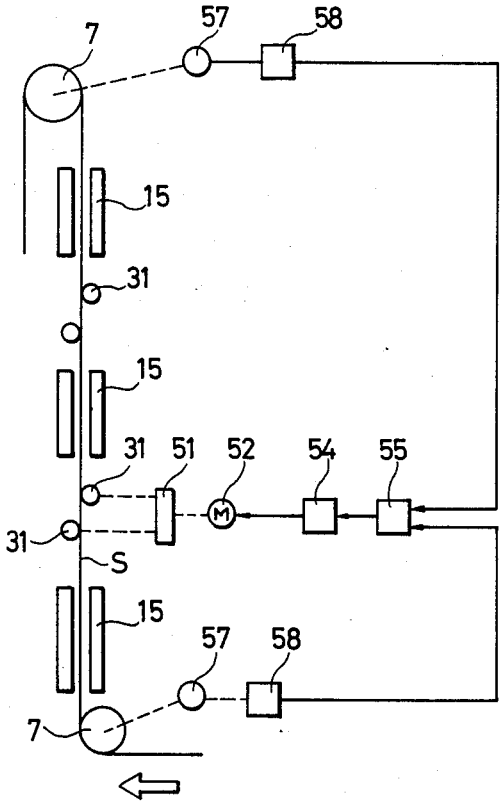
FIG. 12 is a diagram of a system to control the peripheral speed of the holding roll.

As shown in FIG. 12, a driving motor 52 is connected to the holding roll 31 through a distributor 51. The driving motor 52 is either a d.c. or an a.c. motor. To the driving motor 52 is connected a holding roll speed control device 54 and a speed criterion computing device 55. To each of the feed rolls 7 at the top and bottom is connected a feed roll peripheral speed computing device 58 through an rpm detector 57.

The strip S is carried forward by the feed rolls 7 in the direction indicated by the arrow. The rpm detector 57 determines the number of rotations of the feed rolls 7 at the top and bottom. The rpm signal obtained is inputted in the peripheral speed computing device 58 to calculate the peripheral speed of the fed roll. The result is outputted on the speed criterion computing device 55. The speed criterion computing device 55 determines the speed of the strip at a point where the strip is in contact with the holding roll 31 on the basis of the peripheral speed of the top and bottom feed rolls and the distance between the holding roll 31 and the feed rolls 7 and outputs the result on the holding roll speed control device 54 as a peripheral speed criterion signal of the holding roll 31. The holding roll speed control device 54 controls the speed of the holding roll 31 according to a holding roll peripheral speed criterion signal equal to the speed of the strip S passing thereover. The holding roll speed control device 54 performs a variable control of motor voltage and field when the holding roll driving motor is a d.c. motor and a variable control of voltage and frequency when an a.c. motor is used.

Thus rotated with a peripheral speed equal to the speed of the strip S passing over the holding roll 31, the strip S is free of such surface defects as rubbed, scratched and other marks and prevented from fluttering. This permits increasing the travel speed of the strip S as well.

In the above preferred embodiment, the peripheral speed of the holding roll 31 is determined on the basis of the peripheral speed of the feed rolls 7 at the top and bottom. The peripheral speed of the holding roll 31 may also be controlled according to the speed of the strip S passing over the holding roll 31 that is derived from the peripheral speed of either one of the top and bottom feed rolls 7 and the distance between the feed roll 7 chosen and the holding roll 31.

The cooling apparatus of this invention is applicable not only to a vertical continuous annealing furnace as described above but also to a horizontal continuous annealing furnace. The number of gas jet shooting devices, nozzles and holding rolls are not limited to those used with the preferred embodiments described herein.

What is claimed is:

1. A strip cooling apparatus for a continuous annealing furnace to continuously treat elongated steel strip that is fed in the longitudinal direction thereof, which comprises:

a furnace chamber having walls which define a passage for the strip;

a pair of cooling gas chambers attached to the walls of the furnace so as to face each other across the strip, each chamber having a front facing a corresponding side of the strip;

nozzles provided to the front of each cooling gas chamber, each nozzle facing the strip, having a round outlet, shooting forth a stream of pressurized gas to the strip being fed, separated from the strip by a distance z of not more than 70 mm, and projecting from the front of the cooling gas chamber by a length of not less than (100−z) mm;

forced gas circulation means having an intake duct communicating with the furnace chamber and discharge ducts communicating with the cooling gas chamber;

gas cooling means provided in the intake duct;

a pair of rotatable holding rolls disposed on both sides of the strip in a staggered manner and reciprocatably attached to the furnace walls so as to press the strip at a right angle thereto; and means for moving the holding rolls back and forth to the desired positions.

2. A strip cooling apparatus for a continuous annealing furnace to continuously treat steel strip according to claim 1, in which the ratio of the total area of the nozzle outlets to the area of the front side of the cooling gas chamber ranges from 2 to 4 percent and the diameter of the nozzle outlet is not larger than one-fifth of the distance z between the strip and the nozzle outlet.

3. A strip cooling apparatus for a continuous annealing furnace to continuously treat steel strip according to claim 1, which comprises:

feed rolls rotatably supported in the furnace chamber and means for driving said feed rolls to feed the strip passed thereover;

means for detecting the peripheral speed of said feed rolls;

means for calculating the speed of the strip passing over at least one of said holding rolls on the basis of the peripheral speed determined by said detecting means and the distance between said feed rolls and said one holding roll; and means for controlling the peripheral speed of said one holding roll so that the strip speed determined by said calculating means is obtained.

* * * * *